United States Patent [19]

Caspers

[11] 4,180,396

[45] Dec. 25, 1979

[54] METHOD OF ALLOYING AND/OR INOCULATING AND/OR DEOXIDIZING CAST IRON MELTS PRODUCED IN A CUPOLA FURNACE

[75] Inventor: Karl-Heinz Caspers, Nüremberg, Fed. Rep. of Germany

[73] Assignee: Maschinenfabrik Augsburg-Nürnberg Aktiengesellschaft, Nüremberg, Fed. Rep. of Germany

[21] Appl. No.: 854,687

[22] Filed: Nov. 25, 1977

[30] Foreign Application Priority Data

Nov. 24, 1976 [DE] Fed. Rep. of Germany ..... 2653341

[51] Int. Cl.[2] ..... C21C 7/06

[52] U.S. Cl. ..... 75/53; 75/130 R

[58] Field of Search ..... 75/53, 130 R

[56] References Cited

U.S. PATENT DOCUMENTS 3,870,512 3/1975 Lee ..... 75/130 R

*Primary Examiner*—P. D. Rosenberg

*Attorney, Agent, or Firm*—Becker & Becker, Inc.

[57] ABSTRACT

A method of and apparatus for use in connection with alloying, inoculating, and deoxidizing cast iron melts produced in a cupola furnace. An additive, for instance electrode graphite, is continuously added in fine granular form to the surface of the molten iron by means of a dosing device and connecting pipe, the mouth of which is located above the surface of the melt. The additive is added to the molten iron in the furnace channel after the molten iron has left the cupola siphon. Turbulence is imparted to the molten iron in the furnace channel by means of turbulence-inducing element located therein. The additive is added at a rate of between 0.1 and 0.6 percent by weight.

5 Claims, 4 Drawing Figures

Figure 1:
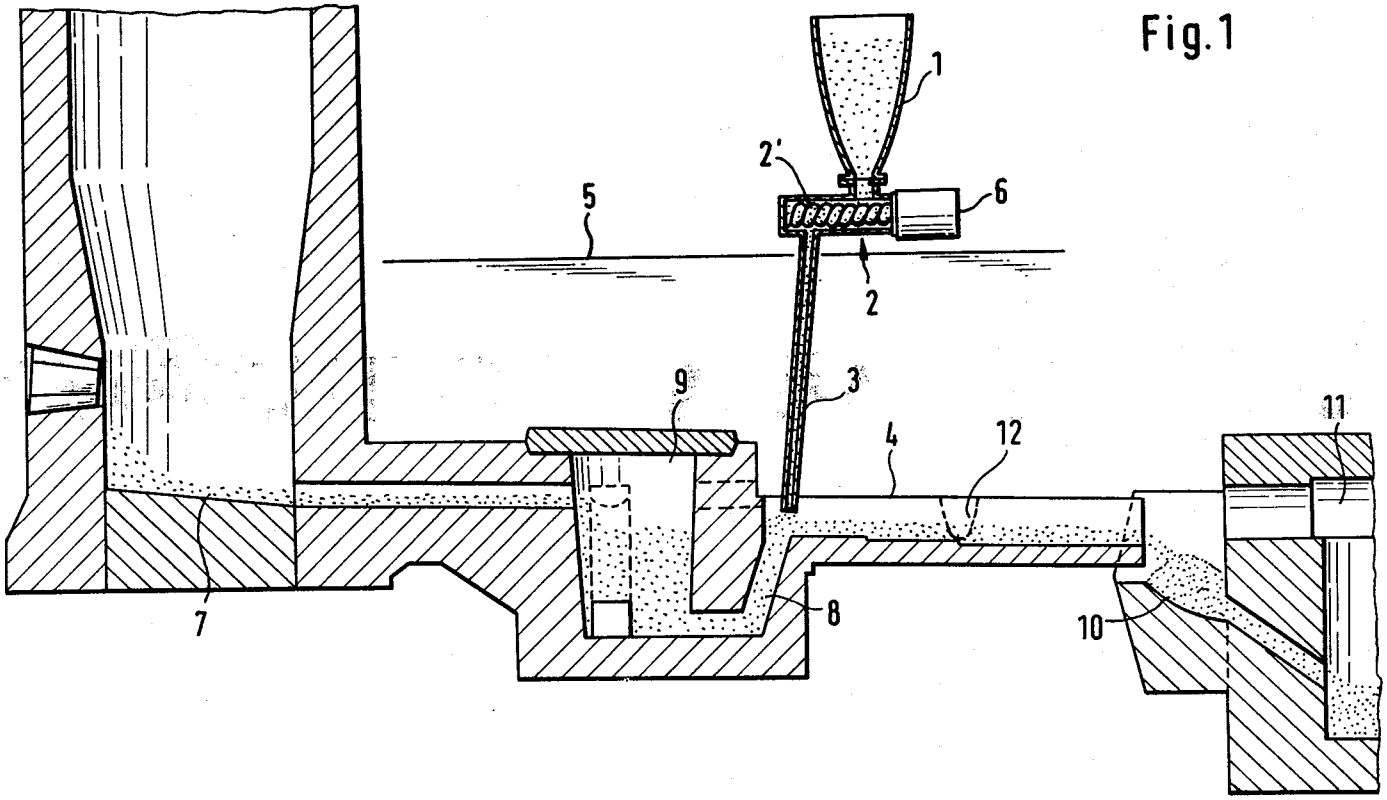

METHOD OF ALLOYING AND/OR INOCULATING AND/OR DEOXIDIZING CAST IRON MELTS PRODUCED IN A CUPOLA FURNACE

The present invention relates to a method of and apparatus for alloying and/or inoculating and/or deoxidizing cast iron melts produced in the cupola furnace, according to which the substances to be added, especially electrode graphite, are added to the molten iron in controlled quantities onto the surface of the molten iron after leaving the cupola siphon.

Especially in engine manufacture, there is a special interest in ensuring uniformity of the mechanical properties both within a casting and from batch to batch. In this connection, tensile strength is the most common criterion for the stress-bearing capability of components made of cast iron. Especailly in the case of cast iron with lamellar graphite, the final properties are already established during the process of cooling down; it is therefore necessary that the chemical composition of the melt and the solidifying conditions be maintained within narrow limits.

It has been found when producing melts in the cupola furnace, that the dispersion or variation of the composition, state of nucleation, and gas content in the molten iron are that much greater the more the chemical composition of all mixture constituents deviates from the desired composition of the molten iron. Mixtures with a high proportion of steel scrap possess a greater heterogeneity; the corresponding molten iron is therefore less consistent or deviates more with regard to the desired chemical composition, gas content, oxide content, and state of nucleation. However, mixtures with a high proportion of steel scrap are less expensive than mixtures with a high proportion of pig iron.

Since adequate homogenizing of the cast iron does not take place in the cupola sump, forehearth, or in the casting ladle, special equipment, such as vibrating ladles or inductively heated channel furnaces have been used in order to avoid the undesirable consequences of a non-uniform cast iron melted in the cupola with a high proportion of scrap in the mixture.

The consequences referred to of cast iron with an irregular composition, irregular gas and oxide content, etc., are mainly as follows: unsatisfactory and highly erratic material properties within the castings and from batch to batch; poor machineability due to structural variations; increased rejection rate and rework costs; increased cost and effort for quality control and quality inspection; increased consumption (per metric ton, i.e., 1000 kg, of molten iron) of inoculation alloys and other alloying substances and enhanced proportion of foundry returns and less output.

A method is known for making cast iron with a spherical shape of the graphite particles, especially one involving the addition of volatile or explosive additives to metal melts of all kinds. In a method of this type, the additives are supplied by a feeding or dosing device, through a vertically positioned pipe which ends near the surface of the melt, onto the metal melt contained in the furnace sump. The additives are stirred into the melt by means of an agitating paddle. The paddle has holes in order to provide turbulence in the immediate vicinity of the melt, so that the additives are thoroughly mixed with the melt. Subsequently, after the mixing has been completed, the slag is drawn off and the molten metal is withdrawn through a valve which is situated in the bottom of the furnace sump. An overflow is provided for drawing off the slag, in which connection the level of the molten metal is regulated by means of the valve provided in the bottom of the furnace sump in such a way that the slag can just pass continuously over the overflow, without a substantial loss in molten metal occurring.

A method as described in the foregoing admittedly permits a metered feed of additives and their thorough mixing with the melt. Since, however, the addition of the additives takes place on the molten metal directly passing from the furnace into the sump, it is inevitable that an unpredictable proportion of additives remains in the slag, which floats on the surface of the molten metal, and is withdrawn with the slag over the overflow. For this reason, it is not possible with this method to achieve in each specific case an accurate composition of the alloy desired. A further serious disadvantage of the method described is seen in the fact that the stirring motions of the paddle continuously stir slag, which is at the surface of the melt, into the molten metal. The castings obtained by means of this method therefore contain a high proportion of slag inclusions, which has a very detrimental effect on the strength of the castings (U.S. Pat. No. 2,677,609).

It is an object of the present invention to further process the case iron, which was melted in the cupola furnace with a high proportion of scrap, with simple and low-cost measures in such a manner that the aimed at and desired chemical composition, undercooling, content of nuclei, and gas and oxide content, is maximized. Another object of the present invention is to maximize the adaptability of the iron in the channel to different casting programs without changing the charge or mixture.

Figure 2A:
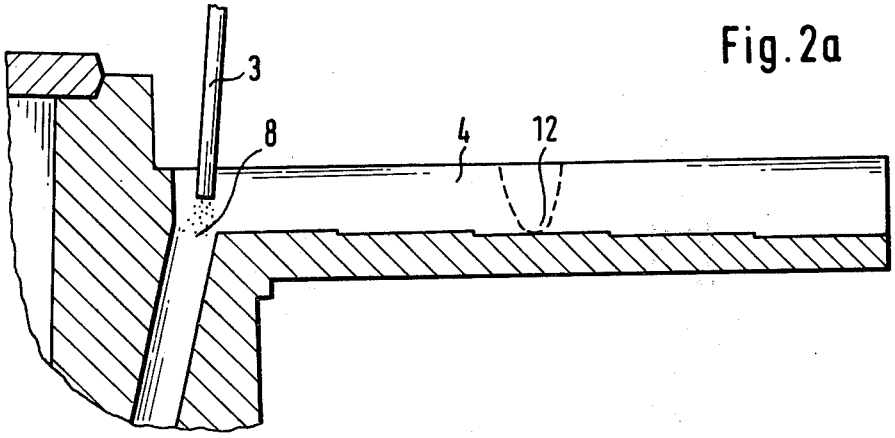
Figure 2B:
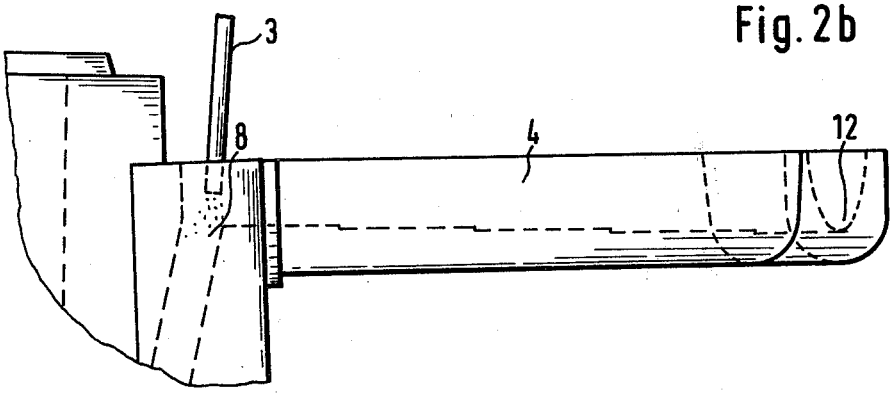
Figure 3:
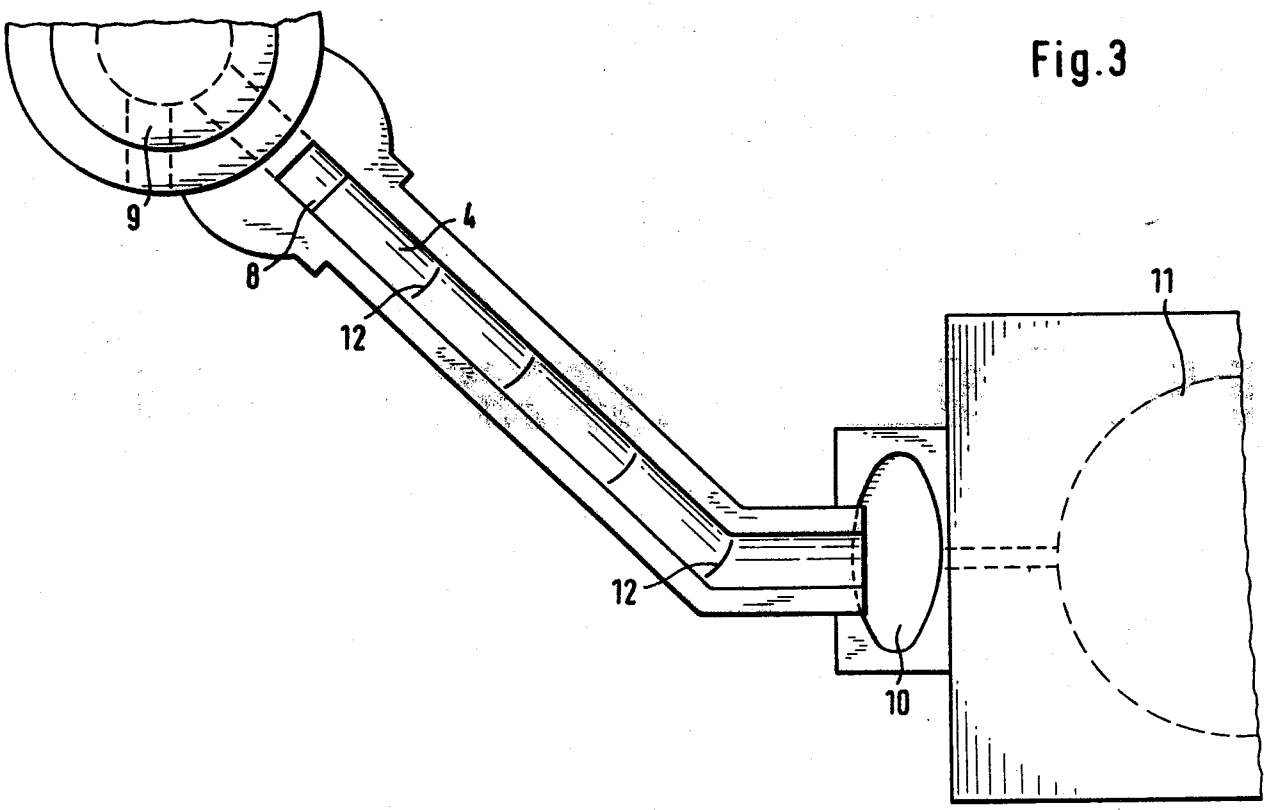

These and other objects and advantages of the present invention will appear more clearly from the following specification in connection with the accompanying drawings, in which:

FIG. 1 is a side view of the apparatus according to the invention in conjunction with a cupola furnace and a forehearth, the latter being sectioned;

FIG. 2*a* shows a portion of FIG. 1 but to a larger scale;

FIG. 2*b* is similar to FIG. 2*a*, but with the turbulence-inducing elements arranged at the end of the furnace channel; and FIG. 3 is a top view of the furnace channel and the forehearth inlet without the feeding or dosing device.

The method for use in connection with alloying, inoculating, and deoxidizing cast iron melts according to the present invention is characterized primarily by continuously feeding the additives in fine granular form into the molten iron flowing in the channel, imparting a turbulent flow to the molten iron by swirl-inducing elements arranged in the channel, and feeding the additives at rates of at least 0.1 percent by weight up to a maximum of 0.6 percent by weight.

An advantageous further development of the invention consists in using as an additive a mixture of electrode graphite and 10 to 25 percent by weight of silicon carbide, with a grain size of silicon carbide between 0.05 and 0.6 mm.

A method of this type offers the advantage of maintaining nucleation by the simultaneous addition of electrode graphite and silicon carbide over an extended period of time without in any way negatively affecting alloy formation and deoxidation, such as is the case when only electrode graphite is added.

While electrode graphite is effective over a shorter period in promoting nucleation, its effect subsides as time progresses, since, especially with the desired thorough mixing and turbulence, it will dissolve quickly and, consequently, will stop acting to promote nucleation. Adding silicon carbide simultaneously with the electrode graphite provides nucleation over a much longer period, since silicon carbide dissolves at a much slower rate and remains positively effective in promoting nucleation even when all the electrode graphite has passed into solution. The proportion of the silicon carbide in the mixture in terms of percentages by weight should be in a range of 10 to 25%. A higher proportion of silicon carbide includes the risk that silicon carbide which has failed to pass into solution will cause inclusions, which result in poor properties of the material. The average grain size should be between 0.05 and 0.6 mm. Too small a grain size would pass too quickly into solution and would stop promoting nucleation. Too great a grain size would dissolve too slowly and would lead to the inclusions referred to above with their negative consequences.

Especially favorable conditions for balancing carbon and/or silicon or other elements for extraneous nuclei formation and deoxidation and for degassing the melts in the forehearth are obtained if, according to a further feature of the method according to the present invention, the addition of the additives into the molten iron occurs directly after the furnace siphon outlet.

Pursuant to another feature of the method of the present invention, the additives are added to the slag-free surface of the molten iron in a predominantly powdery state. Pursuant to yet another feature, the turbulence of the flowing molten iron is maintained even after the additives are added.

The apparatus for implementing the method according to the present invention is characterized primarily in that a feeding or dosing device is provided for the additives, with the outlet of the feeding device communicating with a connecting pipe which terminates above the surface of the molten iron. The apparatus is further characterized in that the furnace channel, downstream of the furnace siphon, is provided with turbulence-inducing elements.

In order to permit an accurate addition of the fine granular substances into the connecting pipe, formed in a preferred embodiment as a gravity chute, as well as to prevent arching of the substances in the storage container, the feeding device, according to a further embodiment of the invention, is provided with a spiral conveyor.

In order to achieve a high degree of turbulence and a higher velocity in the connecting channel between the furnace siphon and the forehearth, the turbulence-inducing elements, in the furnace channel, are suitable steps, deflected members or similar features, and the furnace channel is arranged with a slope of 5° to 15°. This provides more favorable physical and chemical conditions for the continuity of the alloying, inoculation, and deoxidation of the flowing iron.

According to a further embodiment of the invention, the turbulence-inducing element is located directly ahead of the inlet into the forehearth. This arrangement is especially advantageous for the continuous alloying with additive amounts of 0.3 to 0.6 percent by weight.

Referring now to the drawings in detail, in the arrangement shown in FIG. 1, the additive material, such as electrode graphite and/or ferro-alloys and/or silicon carbide, is added in an especially fine granular form from a storage container 1, through a dosing or feeding device 2 in the form of a spiral conveyor or conveyor worm 2' with a highly wear resistant profiled steel shaft and very accurate metering, and through a gravity chute 3, to the furnace channel 4 at a point directly after the siphon outlet. The storage container 1 and the feeding device 2 are supported by the furnace platform 5.

The conveyor worm 2' is drivable by means of a transmission with a flange-mounted motor 6. The ratio of the transmission is variable, with speed variations being possible from 11 to 97 rpm.

The furnace channel 4 connects a cupola furnace 7 or, specifically, the riser 8 of the furnace siphon 9, in a known manner, with the inlet 10 of the forehearth 11.

The furnace channel 4 is provided with swirl- or turbulence-inducing elements 12 in the form of steps or similar features. The furnace channel 4 may have a slope of 5° to 15°.

The turbulence-inducing steps 12 are provided in the vicinity of the point where the additives are added. Swirl- or turbulence-inducing elements may additionally be provided behind the feed point, specifically, directly ahead of the inlet 10 into the forehearth 11.

Fine granular additive material may specifically be powdered material having a low proportion of large grains, i.e., material, 90% of which, in the case of electrode graphite, consists of grain sizes in a range from 0 to 1 mm, and, in the case of silicon carbide, 90% of which consists of grain sizes in a range from 0.05 to 0.6 mm. Where such powdered additive material is used, the mouth of the gravity chute 3 should not be further than 2.5 cm from the surface of the iron (a preferred distance is from 1.5 to 2.5 cm). The cross-sectional area of the gravity chute 3 is preferably about 25 $cm^2$ for additive amounts of 4 to 40 kg per hour in order to obtain a speed of descent of about 5 to 7.5 m/sec.

The admission and cut-off as well as regulation of the feed rate are controlled from the control room as a function of the liquidus temperature of the cast iron. The amount added may also be controlled by means of the tapping plug or as a function of the (quickly determined) chemical composition.

It has been found that the carbon content of the iron in the channel, after leaving the furnace siphon, with a mixture or charge containing 60% steel scrap, will vary between 2.70% and 3.40% during a ten minute period for an associated silicon content of 1.80% to 2.10%. As a result of the continuous addition pursuant to the present invention of very fine granular electrode graphite at 70 g/min to 700 g/min, equivalent to 0.1 to 0.6 percent by weight per ton (1,000 kg) of molten iron, the variation band of the carbon is substantially reduced. Thus, for instance, the carbon content at the inlet 10 into the forehearth 11 amounts to 3.30 to 3.50%, and at the outlet from the forehearth 11 to 3.35 to 3.55%.

The continuous addition of electrode graphite or alloys on a ferro-silicon base and silicon carbide to the molten iron in the furnace channel under conditions of substantial turbulence, even in the case of small amounts of 0.1 to 0.15 percent by weight, brings about: a distinct reduction of undercooling such as arises during eutectic solidification, an increase in the number of eutectic cells per $cm^2$, substantial reduction of white radiation at the tapping plug, increase of the A-graphite proportion, as well as a continuous degassing and cleansing of the iron in the forehearth. By simultaneously influencing the carbon, nucleation, deoxidation and degassification of the iron flowing continuously into the forehearth, there is a substantial improvement in uniformity and a greater flexibility of the melting process in the cupola furnace.

It is, of course, to be understood that the present invention is by no means limited to the specific showing in the drawings, but also comprises any modifications within the scope of the appended claims.

What I claim is:

1. A method for use in connection with alloying, inoculating, as well as deoxidizing cast iron melts produced having an accurate composition setting in a cupola furnace arrangement having a siphon and a channel, which includes the steps of:

transferring clean molten iron from said siphon to said channel;

continuously adding controlled quantities of additive in fine granular form to the upper surface of said clean molten iron in said channel, said additive addition occurring at a rate between 0.1 and 0.6 percent by weight; and continuously imparting a turbulence to said clean molten iron in said channel.

2. A method according to claim 1, in which said additive is in the form of a mixture of electrode graphite and 10 to 25 percent by weight silicon carbide, the grain size of said silicon carbide being between 0.05 and 0.6 mm.

3. A method according to claim 1, in which said additive is added to said molten iron directly after the latter leaves said siphon.

4. A method according to claim 1, which includes the step of maintaining said turbulence of said molten iron beyond the point where said additive is added.

5. A method according to claim 1, which includes the step of adding said additives in predominantly powdered form to a slag-free surface of said molten iron.

* * * * *